United States Patent [19]

Koch

[11] Patent Number: 5,052,939

[45] Date of Patent: Oct. 1, 1991

[54] UTILITY PROTECTOR

[76] Inventor: William C. Koch, E8384 Koch Rd., North Freedom, Wis. 53951

[21] Appl. No.: 473,274

[22] Filed: Feb. 2, 1990

[51] Int. Cl.[5] ..... H01R 13/44

[52] U.S. Cl. ..... 439/133; 439/304; 439/367

[58] Field of Search ..... 439/133, 304, 308, 367, 439/892, 906

[56] References Cited

U.S. PATENT DOCUMENTS 4,382,649 5/1983 Meyer ..... 439/147
4,702,541 10/1987 Arnold ..... 439/304
4,705,335 11/1987 Goebel ..... 439/133
4,749,359 6/1988 White ..... 439/144

FOREIGN PATENT DOCUMENTS 2117818 10/1972 Fed. Rep. of Germany ..... 439/133

*Primary Examiner*—Paula A. Bradley
*Attorney, Agent, or Firm*—Michael I. Kroll

[57] ABSTRACT

A utility protector is disclosed. The utility protector includes a hollow cylindrical tube portion having a first end and a second end, a first substantially closed end disposed at the first end of the tube portion and containing at least one first round hole, and a second substantially closed end disposed at the second end of the tube portion and containing at least one second round hole.

4 Claims, 2 Drawing Sheets

(LOCKED POSITION)
Fig.9 (LOCKED POSITION)

(CLOSED POSITION)

(CLOSED POSITION)

(CLOSED POSITION)

(OPEN POSITION)

(LOCKED POSITION)

(LOCKED POSITION)

(CLOSED POSITION)

UTILITY PROTECTOR

BACKGROUND OF THE INVENTION

1. Field of the Invention

The present invention relates to a utility protector.

More particularly, the present invention relates to a utility protector that locks up and seals off an electrical plug and/or an air hose of at least one machine, from unauthorized usage.

2. Description of the Prior Art

Numerous innovations for utility protectors have been provided in the prior art that are adapted to be used. Even though these innovations may be suitable for the specific individual purposes to which they address, they would not be suitable for the purposes of the present invention as heretofore described.

SUMMARY OF THE INVENTION

Accordingly, it is an object of the present invention to provide a utility protector that avoids the disadvantages of the prior art.

More particularly, it is an object of the present invention to promote safety in the work area, stop inadvertent plugging in of electrical plugs and/or attaching air hose couplings when the safety parts are not in place, machinery is protected from an operator who is unauthorized to use the machinery, for whatever reason.

In keeping with these objects, and with others which will become apparent hereinafter, the first embodiment of the present invention resides, briefly stated, in a utility protector having a substantially hollow cylindrical tube portion with a first end and a second end, a first substantially closed end disposed at the first end of the tube portion and containing at least one first round hole wherein a second substantially closed end is disposed at the second end of the tube portion, and containing at least one second round hole.

In accordance with another feature of the present invention, the hollow cylindrical tube portion has a longitudinal axis upon which the hollow cylindrical tube portion is split into a first half and a second half.

Another feature of the present invention is that the first half contains a first side of the split and a second side of the split.

Yet another feature of the present invention is that the first half is connected at the first side to the second side of the second half of the split, by a hinge.

Still another feature of the present invention is that it further comprises a first flat lip extending out longitudinally from the first half, and a second flat lip extending out longitudinally from the second half.

Yet still another feature of the present invention is that the first flat lip and the second flat lip are substantially identical and contain a first transverse hole, a second transverse hole, and a third transverse hole.

Yet another feature of the present invention is that it further comprises at least on lock cylinder to lock the utility protector.

Still yet another feature of the present invention is that it further comprises at least one pad lock, at least one first transverse hole, at least one second transverse hole, and at least one third transverse hole.

In keeping with these objects, and with others which will become apparent hereinafter, the second embodiment of the present invention resides, briefly stated, in a utility protector having a substantially hollow cylindrical tube portion with a first end and a second end, a first substantially closed end disposed at the first end of the tube portion and containing at least one first oblong hole, and at least one knock-out plug wherein a second substantially closed end is disposed at the second end of the tube portion.

Another feature of the present invention is that the hollow cylindrical tube portion has a longitudinal axis upon which the hollow cylindrical tube portion is split into a first half and a second half.

Yet another feature of the present invention is that the first half contains a first side of the split and a second side of the split.

Still another feature of the present invention is that the first half is connected at the first side to the second side of the second half of the split, by a hinge.

Yet still another feature of the present invention is that it further comprises a first flat lip extending out longitudinally from the first half and a second flat lip extending out longitudinally from the second half.

Still yet another feature of the present invention is that the first flat lip and the second flat lip are substantially identical and contain a first transverse hole, a second transverse hole, and a third transverse hole.

In keeping with these objects, and with others which will become apparent hereinafter, the third embodiment of the present invention resides, briefly stated, in a utility protector having a substantially hollow cylindrical tube portion with a first end and a second end, a first substantially closed end disposed at the first end of the tube portion and containing at least one first round hole and at least one round knock-out plug wherein a second substantially closed end is disposed at the second end of the tube portion.

Another feature of the present invention is that the hollow cylindrical tube portion has a longitudinal axis upon which the hollow cylindrical tube portion is split into a first half and a second half.

Yet another feature of the present invention is that the first half contains a first side of the split and a second side of the split.

Still another feature of the present invention is that the first half is connected at the first side to the second side of the second half of the split, by a hinge.

Yet still another feature of the present invention is that it further comprises a first flat lip extending out longitudinally from the first half, and a second flat lip extending out longitudinally from the second half.

Still yet another feature of the present invention is that the first flat lip and the second flat lip are substantially identical and contain a first transverse hole, a second transverse hole, and a third transverse hole.

Another feature of the present invention is that it further comprises at least one bolt for at least one first transverse hole, at least one second transverse hole, and at least one third transverse hole.

Yet another feature of the present invention is that an electrical plug can be disposed within the utility protector, with the tail wire passing through the round hole, so that the utility protector is secured by at least one bolt.

Still another feature of the present invention is that an air hose coupling can be disposed within the utility protector, with the tail hose passing through the round hole so that the utility protector is secured by at least one padlock.

Yet still another feature of the present invention is that an electrical plug can be disposed within the utility protector and the first hole of the first end contains a wire tail and the second hole of the second end contains a hose tail, simultaneously and providing an integral unit within the utility protector of the present invention.

The novel features which are considered characteristic for the invention are set forth in particular in the appended claims. The invention itself, however, both as to its construction and its method of operation, together with additional objects and advantages thereof, will be best understood from the following description of the specific embodiments when read in connection with the accompanying drawing.

BRIEF DESCRIPTION OF THE DRAWING

FIG. 9 is an end view of the utility protector of the present invention, showing a cylinder lock being used to prevent inadvertent opening of the protector.

LIST OF REFERENCE NUMERALS UTILIZED IN THE DRAWING

Figures 1, 2, 3, 10:
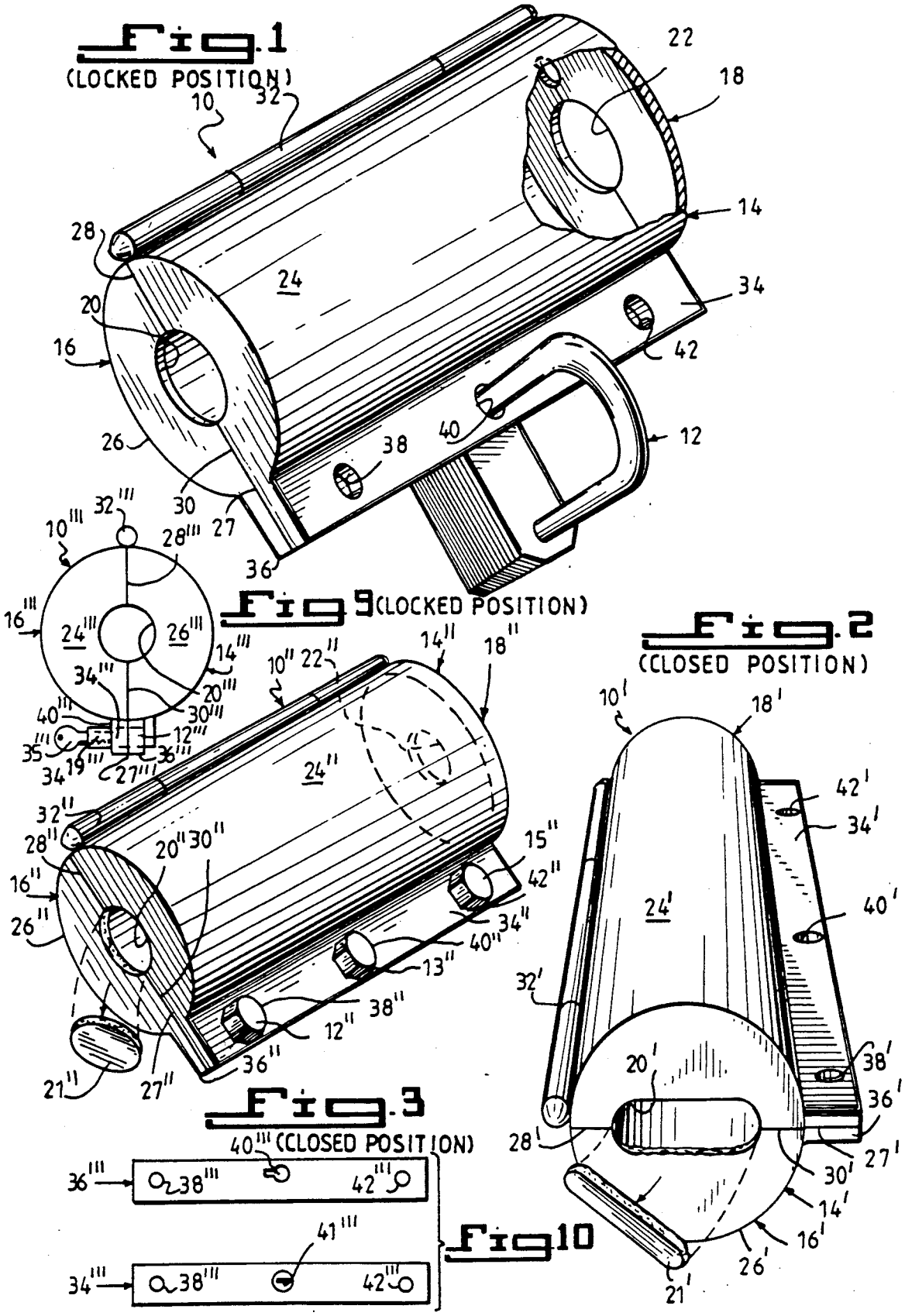
FIG. 1 is a perspective view, with parts broken away, of the utility protector of the present invention, showing at least one padlock being used to prevent inadvertent opening of the utility protector.
FIG. 2 is a perspective view of the utility protector of the present invention, showing the use of an optional substantially rectangular shaped knock-out.
FIG. 3 is a perspective view of the utility protector of the present invention, showing the use of another optional circular shaped knock-out and a plurality of bolts used to keep the utility protector of the present invention in the closed position when not in use.
FIG. 10 is a plan view of the first and second lips of the utility protector of the present invention, shown in FIG. 9, supra.

10—first embodiment of the utility protector of the present invention

12—a pad lock used for the utility protector of the present invention 10

14—a hollow cylindrical tube portion of the utility protector 10 of the present invention

16—first substantially closed end of the hollow cylindrical tube portion 14

18—second substantially closed end of the hollow cylindrical tube portion 14

20—first hole contained in the first substantially closed end 16

22—second hole contained in the second substantially closed end 18

24—first half of the hollow cylindrical tube portion 14

26—second half of the hollow cylindrical tube portion 14

27—longitudinal split of the hollow cylindrical tube portion 14

28—first side of the split of the hollow cylindrical tube portion 14

30—second side of the split of the hollow cylindrical tube portion 14

32—a hinge connecting the first half to the second half of the hollow cylindrical tube portion 14

34—first flat lip of the first half of the hollow cylindrical tube portion 14

36—second flat lip of the second half of the hollow cylindrical tube portion 14

38—first transverse hole of the first flat lip and the second flat lip, respectively

40—second transverse hole of the first flat lip and the second flat lip, respectively

42—third transverse hole of the first flat lip and the second flat lip, respectively

44—an air hose coupling

46—a hose tail of the air hose coupling 44

10'—second embodiment of the utility protector of the present invention

14'—a hollow cylindrical tube portion of the utility protector 10' of the present invention

16'—first substantially closed end of the hollow cylindrical tube portion 14'

18'—second substantially closed end of the hollow cylindrical tube portion 14'

20'—a knock-out slot of the hollow cylindrical tube portion 14'

21'—a knock-out plug of the hollow cylindrical tube portion 14'

24'—first half of the hollow cylindrical tube portion 14'

26'—second half of the hollow cylindrical tube portion 14'

27'—a longitudinal split of the hollow cylindrical tube portion 14'

28'—first side of the split of the hollow cylindrical tube portion 14'

30'—second side of the split of the hollow cylindrical tube portion 14'

32'—a hinge connecting the first half 24' to the second half 26' of the hollow cylindrical tube portion 14'

34'—first flat lip of the first half 24' of the hollow cylindrical tube portion 14'

36'—second flat lip of the second half 26' of the hollow cylindrical tube portion 14'

38'—first transverse hole of the first flat lip 34' and the second flat lip 36', respectively

40'—second transverse hole of the first flat lip 34' and the second flat lip 36', respectively

42'—third transverse hole of the first flat lip 34' and the second flat lip 36', respectively

10''—third embodiment of the utility protector of the present invention

12''—first bolt of the utility protector 10''

13''—second bolt of the utility protector 10''

14''—a hollow cylindrical tube portion of the utility protector 10'' of the present invention

15''—third bolt of the utility protector 10''

16″—first substantially closed end of the hollow cylindrical tube portion 14″

18″—second substantially closed end of the hollow cylindrical tube portion 14″

20″—a knock-out hole

21″—a knock-out plug of the hollow cylindrical tube portion 14″

22″—second hole contained in the second substantially closed end 18″

24″—first half of the hollow cylindrical tube portion 14″

26″—second half of the hollow cylindrical tube portion 14″

27″—a longitudinal split of the hollow cylindrical tube portion 14″

28″—first side of the split of the hollow cylindrical tube portion 14″

30″—second side of the split of the hollow cylindrical tube portion 14″

32″—a hinge connecting the first half 24″-to the second half 26″ of the hollow cylindrical tube portion 14″

34″—first flat lip of the first half 24″ of the cylindrical tube portion 14″

36″—second flat lip of the second half 26″ of the hollow cylindrical tube portion 14″

38″—first transverse hole of the first flat lip 34″ and the second flat lip 36″, respectively 40″—second transverse hole of the first flat lip 34″and the second flat lip 36″, respectively 42″—third transverse hole of the first flat lip 34″ and the second flat lip 36″, respectively 44″—an electrical plug 46″—a wire tail of the electrical plug 44″

10‴—fourth embodiment of the utility protector of the present invention

12‴—cylinder lock

14‴—a hollow cylindrical tube portion of the utility protector 10 of the present invention 16‴—first substantially closed end of the hollow cylindrical tube portion 14

20‴—first hole contained in the first substantially closed end 16

24‴—first half of the hollow cylindrical tube portion 14

26‴—second half of the hollow cylindrical tube portion 14

27‴—longitudinal split of the hollow cylindrical tube portion 14

28‴—first side of the split of the hollow cylindrical tube portion 14

30‴—second side of the split of the hollow cylindrical tube portion 14

32‴—a hinge connecting the first half to the second half of the hollow cylindrical tube portion 14

34‴—first flat lip of the first half of the hollow cylindrical tube portion 14

35‴—key

36‴—second flat lip of the second half of the hollow cylindrical tube portion 14

38‴—first transverse hole of the first flat lip and the second flat lip, respectively 40‴—second transverse hole of the first flat lip and the second flat lip, respectively 41‴—second slotted hole 42‴—third transverse hole of the first flat lip and the second flat lip, respectively

DETAILED DESCRIPTION OF THE PREFERRED EMBODIMENT

Referring now to FIG. 1, the utility protector of the present invention is shown generally at 10, and kept in the closed position by a pad lock 12. The pad lock 12 prevents the inadvertent opening of the utility protector 10 by unauthorized personnel.

As can be seen, the embodiment of FIG. 1 includes a substantially hollow cylindrical tube portion 14 with a first substantially closed end 16 and a second substantially closed end 18. The first substantially closed end 16 contains a first hole 20, and the second substantially closed end 18 contains a second hole 22. Any number of and sizes of the first hole 20 and the second hole 22 are not limited to one on each side, which was chosen for explanatory purposes only.

The substantially hollow cylindrical tube portion 14 is split 27 into a first half 24 and a second half 26 the first half 24 contains a first side 28 of the split 27 and a second side 30 of the split 27, respectively.

The first half 24 is connected, at the first sides 28 of the split 27, to the second half 26 of the split 27, by a hinge 32.

A first flat lip 34 extends out from the first half 24, while a second lip 36 extends out from the second half 26. The first flat lip 34 and the second flat lip 36 are substantially identical and contain a first transverse hole 38, a second transverse hole 40, and a third transverse hole 42.

With the hollow cylindrical tube portion 14 being in the closed position, the holes 38, 40 and 42 of the lips 34 and 36, respectively, line up. The pad lock 12 is free to enter any of the holes 38, 40, and 42, respectively, or lock the utility protector 10 in the closed position.

It should be noted that the first lip 34 and the second lip 36 can contain any number of holes and is not limited to three, since three was chosen for explanatory purposes only.

It should also be noted that any number of pad locks 12 and is not limited to one, since one was chosen for explanatory purposes only.

Referring now to FIG. 2, the utility protector of the present invention is shown generally at 10′.

As can be seen, the embodiment of FIG. 2 includes a substantially hollow cylindrical tube portion 14′ having a first substantially closed end 16′ and a second substantially closed end 18′. The first substantially closed end 16′ contains a knockout slot 20′ of the knock-out plug 21′. Any number of and size of the knock-out slot 20′ are not limited to one which was chosen for explanatory purposes only.

The substantially hollow cylindrical tube portion 14′ is split 27′ into a first half 24′ and a second half 26′. The first half 24′ contains a first side 28′ of the split 27′ and a second side 30′ of the split 27′, respectively.

The first half 24, is connected, at the first side 28′ of the split 27′, to the second half 26′ of the split 27′, by a hinge 32′.

A first flat lip 34′ extends out from the first half 24′, and a second lip 36′ extends out from the second half 26′. The first flat lip 34′ and the second flat lip 36′ are substantially identical and contain a first transverse hole 38′, a second transverse hole 40′, and a third transverse hole 42′.

With the hollow cylindrical tube portion 14′ being in the closed position, the holes 38′, 40′ and 42′ of the lips 34′ and 36′, respectively, line up.

It should be noted that the first flat lip 34' and the second flat lip 36' can contain any number of holes and are not limited to three, since three was chosen for explanatory purposes only.

Referring now to FIG. 3, the third embodiment of the utility protector of the present invention is shown generally at 10'', kept in the closed position by a plurality of bolts 12'', 13'', and 15''. The bolts 12'', 13'', and 15'' prevent the inadvertent opening of the utility protector 10'' of the present invention, by unauthorized personnel.

As can be seen, the embodiment of FIG. 3 includes a substantially hollow cylindrical tube portion 14'' having a first substantially closed end 16'' and a second substantially closed end 18''. The first substantially closed end 16'' contains a knockout hole 20'' of the knock-out plug 21'', and the second substantially closed end 18'' contains a second knock-out hole 22''. Any number of and sizes of the first hole 20'' and the second hole 22'' are not limited to one on each side which was chosen for explanatory purposes only.

The substantially hollow cylindrical tube portion 14'' is split 27'' into a first half 24'' and a second half 26''. The first half 24'' contains a first side 28'' of the split 27'' and a second side 30'' of the split 27'', respectively.

The first half 24'' is connected, at the first sides 28'' of the split 27'', to the second half 26'' of the split 27'', by a hinge 32''.

A first flat lip 34'' extends out from the first half 24'', and a second flat lip 36'' extends out from the second half 26''. The first flat lip 34'' and the second flat lip 36'' are substantially identical and contain a first transverse hole 38'', a second transverse hole 40'', and a third transverse hole 42''.

With the hollow cylindrical tube portion 14'' being in the closed position, the holes 38'', 40'' and 42'' of the lips 34'' and 36'', respectively, line up. The bolts 12'', 13'', and 15'' enter any of the holes 38'', 40'', and 42'', respectively, and lock the utility protector 10'' of the present invention in the closed position. It should be noted that the first lip 34'' and the second lip 36'' can contain any number of holes and is not limited to three, since three was chosen for explanatory purposes only.

It should also be noted that any number of bolts 12'', 13'', and 15'' are not limited to three, since three was chosen for explanatory purposes only.

Figure 4:
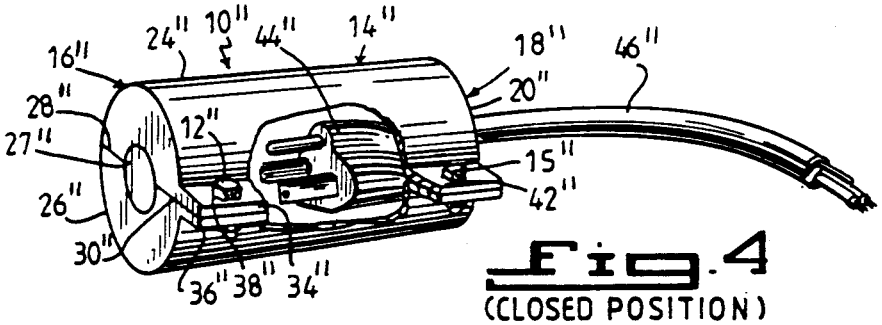
FIG. 4 is a perspective view of, with parts broken away, of the utility protector of the present invention, showing an electrical plug from a utility being protected by the present invention when in the closed position, by the use of the plurality of bolts, shown in FIG. 3, supra.

In operation, as shown in FIG. 4, the third embodiment of the present invention contains and protects an electrical plug 44'' that was placed in the hollow cylindrical tube portion 14'' via the knock-out hole 20'' that was in the open position. The knock-out hole 20'' provides room for the wire tail 46'' of the electrical plug 44'' to be placed when the hollow cylindrical tube portion 14'' is in the closed position, without damaging the wire tail 46''.

Figure 5:
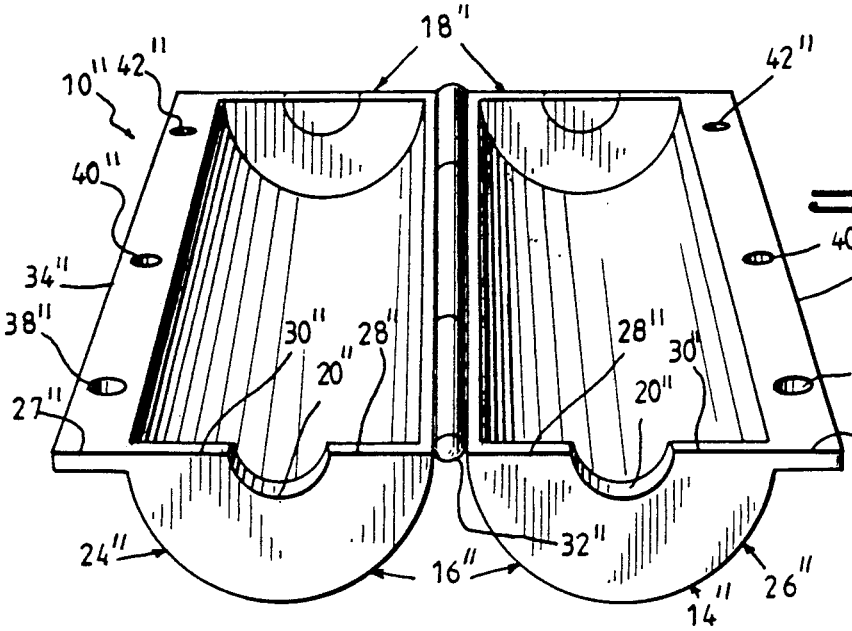
FIG. 5 is a perspective view of the utility protector of the present invention, shown in the opened position.

The details, as previously discussed in part, of the hollow cylindrical tube portion 14'', in the open position, with the bolts 12'', 13'', and 15'', respectively, are shown in FIG. 5.

Figure 6:
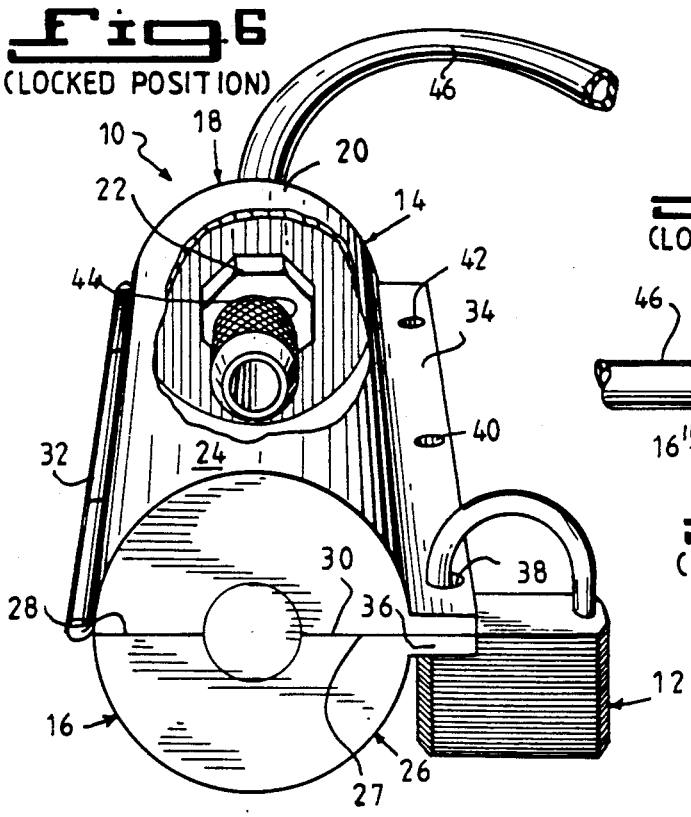
FIG. 6 is a perspective view of, with parts broken away, of the utility protector of the present invention, showing an air hose coupling disposed within the utility protector of the present invention and being locked in the closed position by at least on padlock.

In operation, as shown in FIG. 6, the first embodiment of the utility protector 10 of the present invention, contains and protects an air hose coupling 44, that was placed in the hollow cylindrical tube portion 14 when the hollow cylindrical tube portion 14 was in the opened position. The hole 20 provides room for the air hose tail 46 of the air hose coupling 44 to be placed, when the hollow cylindrical tube portion 14 is in the closed position, without damaging the hose tail 46. The first lip 34 and the second lip 36 meet and line up, respectively, in the closed position. The lip 34 contains the holes 38, 40, and 42, respectively, so that at least one padlock 12 can secure the hollow cylindrical tube portion 14 in the closed, locked position.

Figure 7:
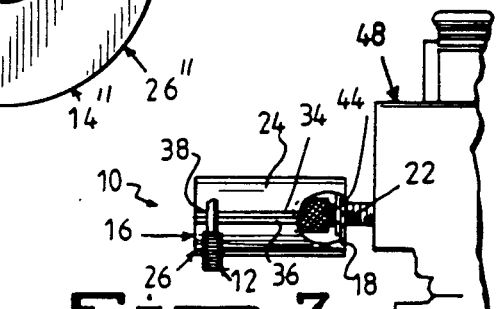
FIG. 7 is a side view, with parts broken away, showing the air hose coupling of FIG. 6, supra, attached to a pneumatic machine while still being protected by the utility protector of the present invention.
Figure 8:
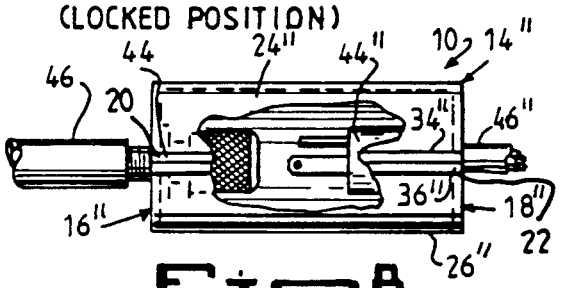
FIG. 8 is a side view, with parts broken away, showing the protection of the air hose of FIG. 6, supra, and the electrical plug of FIG. 4, supra, simultaneously.

For clarity, the utility protector 10 of the present invention, is shown in FIG. 7, attached to a machine 48, via the air hose coupling 44. Additionally, the utility protector 10 of the present invention is also shown in FIG. 8, protecting the electrical plug 44'' and the air hose coupling 44, which utilize the holes 20 and 22 for placement.

An alternate means of securing the present invention in the closed position is to use a cylindrical lock 19 in place of the pad lock 12 of the first embodiment.

The second hole 40 of the flat lips 34 and 36 contain different second holes 41. The first lip 34 uses a keyhole configuration 43, and the second lip 36 is formed with a key slot 44.

The fourth embodiment of the utility protector 10''' of the present invention is shown in FIGS. 9 and 10. The utility protector 10''' is kept in the closed position by a cylinder lock 12'''. The cylinder lock 12''' prevents the inadvertent opening of the utility protector 10''' by unauthorized personnel.

As can be seen, the embodiment of FIG. 9 and 10 includes a substantially hollow cylindrical tube portion 14''' with a first substantially closed end 16'''. The first substantially closed end 16''' contains a first hole 20'''. Any number of and sizes of the first hole 20''' are not limited to one, which was chosen for explanatory purposes only.

The substantially hollow cylindrical tube portion 14''' is split 27''' into a first half 24''' and a second half 26'''. The first half 24''' contains a first side 28''' of the split 27''' and a second side 30''' of the split 27''', respectively.

The first half 24''' is connected, at the first side 28''' of the split 27''', to the second half 26''' of the split 27''', by a hinge 32'''.

A first flat lip 34''' extends out from the first half 24''', while a second flat lip 36''' extends out from the second half 26'''. The first flat lip 34''' and the second flat lip 36''' are substantially identical The first flat lip 34'''. contains a first transverse hole 38''', a second slotted hole 41''', and a third transverse hole 42'''.

With the hollow cylindrical tube portion 14''' being in the closed position, the holes 38''' and 42''' of the lips 34''' and 36''', respectively, line up. The cylinder lock 12''' is disposed in the holes 40''' and 41''', respectively, and lock the utility protector 10''' in the closed position. The cylinder lock 12''' is operated by the key 35'''.

It should be noted that the first lip 34''' and the second lip 36''' can contain any number of holes and is not limited to three, since three was chosen for explanatory purposes only.

It should also be noted that any number of cylinder locks and is not limited to one, since one was chosen for explanatory purposes only.

It will be understood that each of the elements described above, or two or more together, may also find a useful application in other types of constructions differing from the type described above.

While the invention has been illustrated and described as embodied in a utility protector, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A utility protector, comprising:

a) a substantially hollow cylindrical tube portion having a first round end and a second round end, said hollow cylindrical tube portion has a longitudinal axis upon which said hollow cylindrical tube portion is split into a first half round and a second half round, said first half round contains a first side of said split and a second side of said split, said first half round is connected at said first side to a second side of said second half round of said split, by a hinge, b) a first substantially round closed end disposed at said first round end of said tube portion and containing at least one first hole, said first hole being disposed at said center of said first substantially round closed end;

c) a second substantially round closed end disposed at said second round end of said tube portion and containing at least one second hole, said second hole being disposed at said center of said second substantially round closed end;

d. a first flat lip extending out longitudinally the complete length of said first half and a second flat lip extending out longitudinally the complete length of said second half;

e) a padlock must be closed for keeping the utility protector locked and said first flat lip and said second flat lip together form the closed portion, however, said padlock must be opened for keeping said first flat lip and said second flat lip apart in the opened position so that the interior of the utility protector can be viewed, said axis of the latch must coincide with said longitudinal axis of the opening of said lip in order to expose the contents of the interior of the utility protector;

f) a first knock out plug disposed in said first hole and removable when necessary;

g) a second knock out plug disposed in said second hole and removable when necessary.

2. A protector as defined in claim 1, wherein said first flat lip and said second flat lip are substantially identical and contain a first transverse hole, a second transverse hole, and a third transverse hole.

3. A protector as defined in claim 2; further comprising at least one lock cylinder to lock the utility protector.

4. A protector as defined in claim 3; further comprising at least one pad lock, at least one said first transverse hole, at least one said second transverse hole, and at least one said third transverse hole, to lock the utility protector.

* * * * *